United States Patent [19]

Gotoh et al.

[11] 4,429,676

[45] Feb. 7, 1984

[54] EXHAUST GAS RECIRCULATION CONTROL SYSTEM FOR VEHICLE ENGINES

[75] Inventors: Osamu Gotoh, Tokyo; Yutaka Otobe, Saitama; Michio Kawamoto, Tokyo; Akira Fujimura, Saitama, all of Japan

[73] Assignee: Honda Giken Kogyo Kabushiki Kaisha, Tokyo, Japan

[21] Appl. No.: 396,276

[22] Filed: Jul. 8, 1982

Related U.S. Application Data

[63] Continuation of Ser. No. 228,218, Jan. 26, 1981, abandoned.

[30] Foreign Application Priority Data

Feb. 2, 1980 [JP] Japan ..... 55-11763

[51] Int. Cl.[3] ..... F02M 25/06

[52] U.S. Cl. ..... 123/571; 123/568

[58] Field of Search ..... 123/568, 571

[56] References Cited

U.S. PATENT DOCUMENTS

| | | | |
|---|---|---|---|
| 3,282,261 | 11/1964 | Bartholomew . | |
| 3,680,318 | 8/1972 | Nakajima et al. | 60/278 |
| 3,800,766 | 4/1974 | Schubeck | 123/568 |
| 4,125,099 | 11/1978 | Nouthuka | 123/568 |
| 4,168,683 | 9/1979 | Hata et al. | 123/571 |
| 4,170,972 | 10/1979 | Aoyama | 123/568 |
| 4,208,995 | 6/1980 | Simko et al. | 123/571 |
| 4,257,382 | 3/1981 | Matsui et al. | 123/571 |
| 4,300,516 | 11/1981 | Hayakawa | 123/571 |

FOREIGN PATENT DOCUMENTS

| | | | |
|---|---|---|---|
| 53-17803 | 2/1978 | Japan | 123/571 |
| 54-30304 | 3/1979 | Japan . | |
| 54-36425 | 3/1979 | Japan . | |
| 54-72334 | 6/1979 | Japan . | |
| 55-54658 | 4/1980 | Japan . | |
| 2068458 | 8/1981 | United Kingdom | 123/571 |

*Primary Examiner*—Wendell E. Burns
*Attorney, Agent, or Firm*—Lyon & Lyon

[57] ABSTRACT

An internal combustion engine for a vehicle has an exhaust gas recirculation system for returning exhaust gases to the engine intake passage. The carburetion system for the engine includes a fuel enrichment valve. A control suction air line from the intake passage operates a regulating valve which controls the exhaust gas recirculation valve as well as the fuel enrichment valve. The flow resistance through the control suction air line is controlled by a prescribed control factor, which factor may depend upon the engine temperature alone or supplemented by engine speed, engine load (suction pressure), or atmospheric pressure.

12 Claims, 4 Drawing Figures

EXHAUST GAS RECIRCULATION CONTROL SYSTEM FOR VEHICLE ENGINES

This is a continuation, of application Ser. No. 228,218, filed Jan. 26, 1981 now abandoned.

This invention relates to an exhaust gas recirculation control system for a vehicle engine employing exhaust gas recirculation, the vehicle engine having a carburetor equipped with a fuel enrichment device.

Exhaust gas recirculation systems are conventionally employed in engines which operate to return part of the exhaust gas emitted from the engine to the engine intake passage via an exhaust gas recirculation passage during the operation of the engine to prevent excessive increase of the combustion temperature of the mixture in the engine cylinders. Lowering of the combustion temperature reduces the output of nitrogen oxides which are objectionable from the standpoint of atmospheric air contamination. Further, a system is also known which operates to supply the engine with a mixture having a high overall air-fuel ratio in order to reduce the concentrations of hydrocarbon, monoxide, nitrogen oxides, etc. contained in the exhaust gas. The above two systems can both be employed in engines so as to further reduce the concentration of nitrogen oxides in the exhaust gas. However, all the above-mentioned systems have to some degree an unfavorable influence upon the driveability of the vehicle.

The present invention has been devised in view of the above circumstances, and it is an object of the invention to provide a system of the above-mentioned type which operates to increase the quantity of auxiliary fuel being supplied to the engine, and at the same time increase the flow rate of exhaust gas being returned to the engine intake passage. This action serves to restrain the rise in combustion temperature which would otherwise occur by reason of the increased fuel quantity, thus achieving enhancement of the engine power characteristic and reduction of air contamination at the same time.

IN THE DRAWINGS

Figure 1:
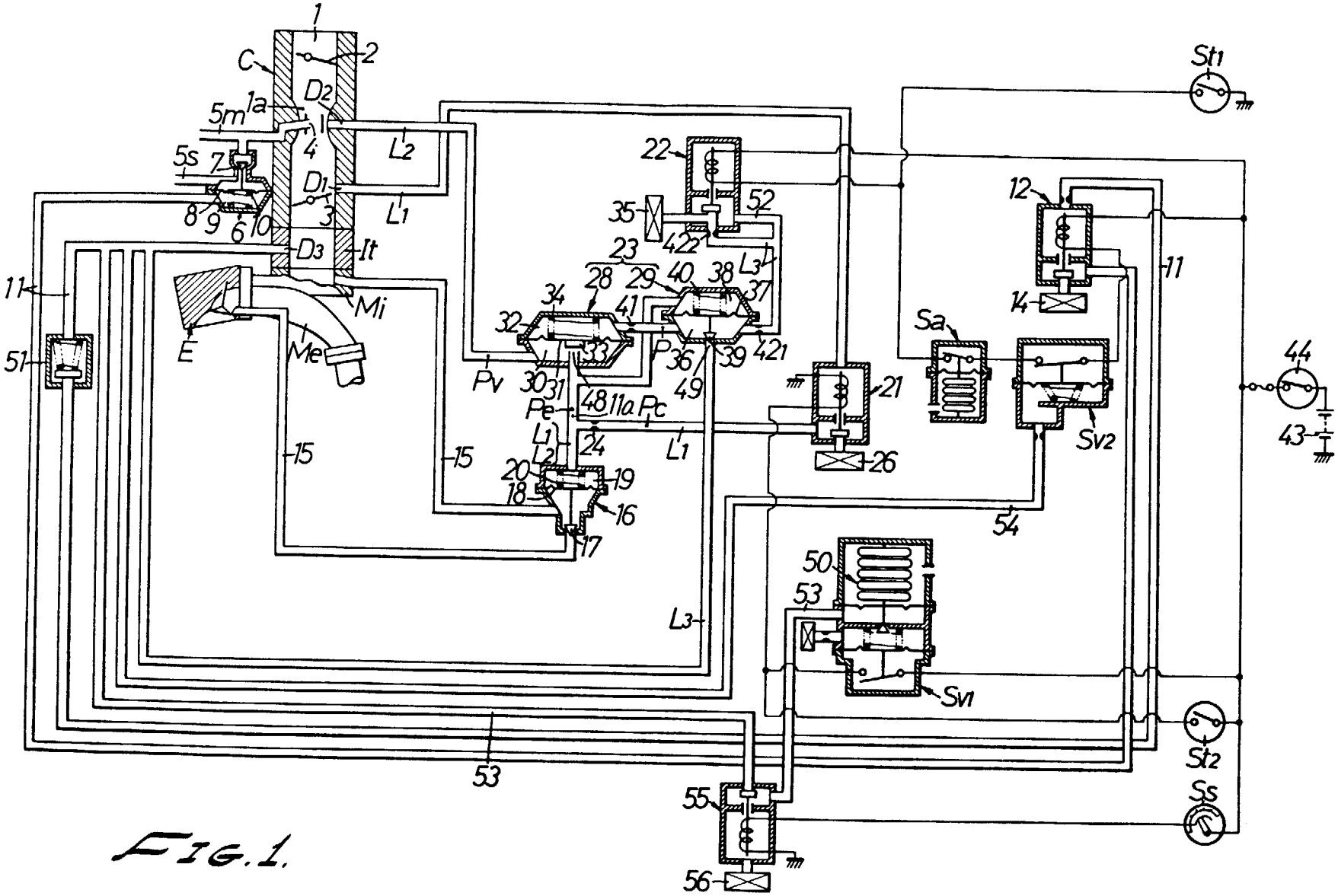
FIG. 1 is a schematic diagram, partly in section, showing a preferred embodiment of this invention.

Referring to the drawings, the automobile engine generally designated E is provided with an intake manifold Mi and an exhaust manifold Me. A carburetor C is connected to an upstream end of the intake manifold Mi through a heat insulating barrel It.

The carburetor C includes a venturi 1*a* provided in the intake passage 1. A choke valve 2 is positioned upstream of the venturi 1*a* and a throttle valve 3 is positioned downstream of the venturi 1*a*. A fuel nozzle 4 opens into the venturi 1*a*. The intake manifold Mi, the heat insulating barrel It and the carburetor C constitute the intake passage 1 of the engine E. A first suction port D1 is located in the vicinity of or downstream from the throttle valve 3, and a second suction port D2 opens into the venturi 1*a*. A third suction port D3 is positioned at a location downstream of the throttle valve 3.

A fuel passage leading to the fuel nozzle 4 comprises a main fuel passage 5*m* and an auxiliary fuel passage 5*s*, both of which communicate with a float chamber, not shown, in which float chamber the passages 5*m* and 5*s* open below the fuel surface level. The auxiliary fuel passage 5*s* is provided with a fuel supply increasing valve 6. The valve 6 includes a movable valve element 7 arranged to open or close the auxiliary fuel passage 5*s*. The valve 6 also includes a diaphragm 8 connected to the valve element 7, and a valve spring 10 positioned within the suction pressure chamber 9 below the valve element 7. The spring 10 urges the valve element 7 in the valve-opening direction.

The suction chamber 9 of the fuel supply increasing valve 6 communicates with the third suction port D3 via a suction passage 11 in which a solenoid valve 12 is provided. This valve 12 operates to open the suction passage 11 when its solenoid is energized, and closes the same passage 11 and simultaneously connects the downstream side of the passage 11 with an air intake port 14 provided with a filter, when the solenoid is de-energized.

Therefore, when the solenoid valve 12 is deactivated, the fuel supply increasing valve 6 operates to allow suction pressure detected by the third negative pressure detecting port D3, that is, suction pressure produced by the operation of the engine E to be introduced into the suction pressure chamber 9, so that the valve element 7 is displaced in the closing direction. Thus, as the suction pressure decreases with an increase in the engine load, the valve element 7 is correspondingly displaced in the opening direction to strengthen the fuel supply increasing function of the valve 6 for fuel supply to the fuel nozzle 4. When the engine load decreases, the fuel supply increasing function is weakened in a manner opposite to that described above. On the other hand, when the solenoid valve 12 is activated or is in an operative state, the suction pressure chamber 9 of the fuel supply increasing valve 6 has suction pressure present therein which is diluted through the air intake port 14. The valve body 7 is then displaced to its maximum opening position to cause the fuel supply increasing function to operate at the maximum extent.

A check valve 51 is provided in the suction pressure line 11, which operates when the engine E is stopped, to confine the actuating suction pressure holding the valve element 7 in its closing position, so as to avoid leakage of fuel from the fuel supply increasing valve 6.

An exhaust gas recirculation conduit 15 extends from an exhaust port of the engine E and communicates with the intake manifold Mi, with a flow rate control valve 16 provided in the conduit 15. Valve 16 includes a movable valve element 17 operated by a diaphragm 18. A valve spring 20 is positioned within the suction chamber 19 formed above the diaphragm 18 and acts to urge the valve element 17 toward closed position.

The first suction line L1 extends from the suction port D1 through the solenoid-operated air valve 21 to the suction chamber 19 of the flow rate control valve 16. An orifice 24 is located downstream of the valve 21 in the suction line L1. A second suction line L2 extends from the suction port D2 to the suction chamber 19 by way of the regulating valve 28. The air valve 21 operates to close the upstream side of its suction line L1, and simultaneously connect the downstream side with the air intake port 26 provided with a filter.

The control valve generally designated 23 includes a suction pressure responsive type regulating valve 28 arranged to open or close the second suction line L2, and also includes an air valve 29 of the suction pressure responsive type adapted to adjust the suction pressure acting upon the regulating valve 28. The regulating valve 28 includes a valve chamber 30 connected to the second suction line L2 and also includes a suction chamber 32 separated from the valve chamber 30 by the diaphragm 31. A flat movable valve element 33 fixed to the diaphragm 31 opens and closes with respect to a valve port 48 at the open end of the line 11*a* extending between the regulating valve 28 and the recirculation control valve 16. A valve spring 34 urges the valve element 33 toward its closed position.

The air valve 29 is comprised of a valve chamber 36 positioned in a third suction line L3 extending from the third suction port D3 and leading to an air intake port 35 provided with a filter. A suction chamber 38 is separated from the valve chamber 36 by the diaphragm 37. A movable valve element 39 secured on the diaphragm 37 is positioned to vary the opening of a valve port 49 formed at the open end of the third suction line L3. A valve spring 40 is arranged to urge the valve element 39 in its closing direction. The valve element 39 of this valve 29 has a configuration similar to that of the valve element 17 of the aforementioned flow rate control valve 16. The suction chamber 38 communicates with the first suction line L1 located downstream of the regulating valve 28, while the valve chamber 36 communicates with the pressure chamber 32 via an orifice 41. Another orifice $42_1$ is provided at a location between the valve chamber 36 and the air intake port 35. A suborifice $42_2$ has a smaller opening. A channel 52 bypasses only the suborifice $42_2$. Interposed between the bypass channel 52 and the air intake port 35 is a solenoid valve 22 which normally closes the bypass channel 52 and, when its solenoid is energized, opens the same channel.

In the present specification, the terms "upstream side" and "downstream side" of the suction lines mean "suction pressure supply source side" and "air intake port side", respectively.

When the solenoid valves 21, 22 are de-activated, the suction pressure control valve 23 operates as follows:

A suction pressure is produced in the vicinity of the throttle valve 3 or at a location downstream of same as the engine E operates, and is detected as suction pressure Pc at the first suction pressure point D1. The suction pressure Pc is transmitted to the chamber 38 of the air valve 29 via the solenoid valve 21 and the orifice 24, so that when the suction pressure Pc overcomes the setting load of the valve spring 40, it lifts the valve element 39 together with the diaphragm 37 to open the third suction pressure line L3.

When the third suction pressure line L3 is thus opened, atmospheric air is introduced into the third suction line L3 via the intake port 35, restricted in flow rate by the main orifice $42_1$ and the suborifice $42_2$, and supplied to the intake passage 1 of the engine E via the valve chamber 36 and the valve port 49, and then into the intake passage 1 of the engine E. As a consequence, suction pressure P produced in the valve chamber 36 of the air valve 29 is transmitted to the suction chamber 32 of the regulating valve 28. When the difference between the suction pressure P and the detected suction pressure Pv, at the second suction port D2, overcomes the setting load of the valve spring 34, the valve element 33 is lifted together with the diaphragm 31 to open the valve port 48. Part of the suction pressure Pv escapes through the valve port 48 to dilute or reduce the intensity of the suction pressure which has previously passed the orifice 24 into suction pressure Pe in line 11*a*. This suction pressure Pe serves as actuating pressure in the chamber 19 of the flow rate control valve 16.

Due to the above dilution or reduction of intensity in the suction pressure, the suction pressure present in the chamber 38 is reduced, and accordingly the opening of the air valve 29 is reduced which results in a corresponding decrease in the suction pressure in the valve chamber 36. The suction pressure in the chamber 32 of the regulating valve 28 also decreases so that the valve element 33 closes the valve port 48. Then the suction pressure Pe increases. This cycle of operation is repeated. Since this repetition occurs very quickly, the quantity of air travelling in the third suction passage L3 becomes proportional to the quantity of air being sucked into the engine E so that the suction pressure P has a value approximate to that of the suction pressure Pv.

Thus, when the quantity of air being sucked into the engine E is small, the suction pressure P is higher than the suction pressure Pv and accordingly the valve element 33 of the regulating valve 28 is displaced into its open position to decrease the actuating pressure Pe for the flow rate control valve 28. On the other hand, when the quantity of suction air increases, the suction pressure Pv increases so that the valve element 33 is displaced into its closing position to increase the actuating pressure Pe. In this manner, the air valve 29 and the flow rate control valve 16 are actuated by the same suction pressure Pe. Further, their respective valve elements 39, 17 are similar in configuration to each other. Therefore, the quantity of air flowing into the third suction pressure passage L3, that is, the quantity of air being sucked into the engine E, is proportional to the quantity of exhaust gas being returned to the suction passage so that the engine E can be supplied with exhaust gas at a permanently constant return ratio.

When the orifices $42_1$, $42_2$ provided in the control suction air line L3 have both been put into action, the flow rate of air flowing in the suction air line L3 is largely restricted, thus keeping the flow rate of recirculating exhaust gas at a low value. Therefore, if the bypass channel 52 is opened by activation of the solenoid valve 22, air which is sucked into the air intake port 35 is allowed to pass through the bypass channel 52, that is, bypassing the suborifice $42_2$ to reach the main orifice $42_1$. Thus, the flow rate of sucked air is restricted solely by the main orifice $42_1$, resulting in an increase in flow rate of recirculation exhaust gas.

On the other hand, when the solenoid valve 21 is activated to block the upstream side of the first suction pressure line L1 and simultaneously allow the downstream side of same to communicate with the air intake port 26, the actuating suction pressure Pe is replaced by atmospheric pressure which closes the flow rate control valve 16, resulting in cessation of recirculation of exhaust gas.

The control system for the above-mentioned solenoid valves 12, 21, 22 is mainly comprised of vehicle speed sensing switch Ss, first and second engine temperature sensing switches St1, St2, and first and second vacuum pressure detecting switches Sv1, Sv2. The switches Sv1, Sv2 communicate with the third suction pressure detecting port D3, respectively, by way of suction pressure lines 53 and 54, solenoid valve 55 in the suction pressure line 53 and an atmospheric pressure sensing switch Sa. The switch Ss turns off when the vehicle speed drops below a predetermined value (e.g., below 20 km/h). The switch St1 detects the temperature of engine cooling water as engine temperature and closes when the temperature exceeds a predetermined value (e.g., 75° C.). The switch St2 also senses the temperature of the cooling water of the engine and when the engine temperature exceeds a predetermined value (e.g., 60° C.), it turns off. The switch Sv1 closes when the suction pressure detected by the third suction port D3 exceeds a predetermined value (e.g., 500 mm Hg). The switch Sv2 closes when said suction pressure exceeds a relatively smaller predetermined value (e.g., 300 mm Hg). The switch Sa senses atmospheric pressure. When atmospheric pressure decreases below a predetermined value, e.g., 660 mm Hg, it turns off. The solenoid valve 55 is adapted to close the upstream side of the suction pressure line 53 and simultaneously allow the downstream side of same to communicate with the air intake port provided with a filter. When its solenoid is energized, it opens the suction pressure line 53. The first suction pressure sensing switch Sv1 is provided with bellows 50 for correcting the value of the actuating suction pressure acting upon the switch Sv1 in response to a change in the atmospheric pressure.

Figure 2:
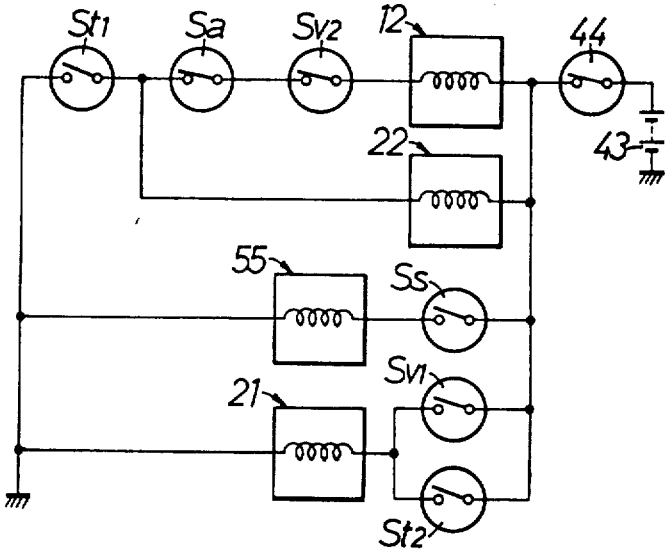
FIG. 2 shows a modification.

The electrical circuit elements constituting the control system shown in FIG. 1 can be arranged as shown in FIG. 2. The solenoid valves 12 and 22 are connected, in parallel, to the power source 43 by way of the first temperature sensing switch St1. Provided in the energizing circuit for the solenoid valve 12 are the second suction pressure sensing switch Sv2 and the atmospheric pressure sensing switch Sa which are connected in parallel. The solenoid valve 21 is connected to the power source 43 by way of the first suction pressure sensing switch Sv1 and the engine temperature sensing switch St1 which are connected in parallel. The solenoid valve 55 is connected to the power source 43 by way of the vehicle speed sensing switch Ss. The reference numeral 44 designates an ignition switch of the engine E.

When the engine E is started by turning on the ignition switch 44, the solenoid valve 12 is activated by the switches Sa, St1, Sv2 when all the switches are closed, that is, when the atmospheric pressure assumes a normal value because the vehicle is running in a low altitude location, and the engine is in warmed-up state (e.g., the cooling water temperature in the cylinder block is 70° C. or more), and simultaneously the engine load has largely dropped below a predetermined value, e.g., 300 mm Hg, such as in sudden acceleration or running up a slope. As a consequence of this activation of the solenoid valve 21, the fuel supply increasing function of the fuel supply increasing valve 6 is carried out to the fullest extent to increase the quantity of fuel provided from the carburetor C, thus obtaining high engine power as well as improved driveability of the vehicle.

Simultaneously with the above activation of the solenoid valve 12, the solenoid valve 22 is also activated by means of the switch St1 which is then closed so that the flow rate of exhaust gas being recirculated is increased thereby to effectively restrain the production of nitrogen oxides which would otherwise be generated by the increased engine power.

When any one of the above three switches Sa, Sv2 or St1 is open, that is, when the vehicle is running in a high altitude place with low atmospheric pressure, or when the engine is operated under low load, or when the engine is in a cold state, the solenoid valve 12 is de-activated to thereby decrease the fuel supply increasing function of the fuel supply increasing valve 6. The reason for the de-activation of the solenoid valve 12, particularly when the engine is running at a high altitude place, lies in that the mixture produced by the carburetor C is apt to be rich since in such place the air density supplied to the engine is reduced due to low atmospheric pressure.

When the engine is in a cold state, the second engine temperature sensing switch St2 turns on to activate the solenoid valve 21. As a consequence, the flow rate control valve 16 has its actuating suction pressure released through the air intake port 26 and accordingly becomes closed, thus interrupting exhaust gas recirculation. That is, weakening of the fuel supply increasing function of the fuel supply increasing valve and interruption of the exhaust gas recirculation are carried out at the same time. The reason for this concurrent dual action lies in the fact that nitrogen oxides are produced in only small quantities when the engine is in a cold state, and that it is desirable to restrain the production of unburned components in the exhaust gas.

When the vehicle is decelerated (engine brake) while the vehicle speed is in a middle or high speed range with the solenoid valve 55 closed by the vehicle speed sensing switch Ss the suction pressure line causes the switch Sv1 to close and the switch Sv2 to open when the suction pressure produced by the engine operation increases over a predetermined value, for example, 500 mm Hg. Therefore, the fuel supply increasing function of the fuel supply increasing valve 6 is interrupted and also the exhaust gas recirculation is interrupted at the same time. The reason for the above manner of control lies in the fact that the amount of nitrogen oxides produced in the exhaust gas is small during such deceleration of a vehicle.

If the vehicle speed is in a low speed range, e.g., 20 km/h or less, the switch Ss is off to have the solenoid valve 55 de-activated so that the switch Sv1 turns off to release the actuating suction pressure acting on the valve 55 through the air intake port 56. As a consequence, the solenoid valve 21 returns to its normal position to re-establish exhaust gas recirculation.

Figure 3:
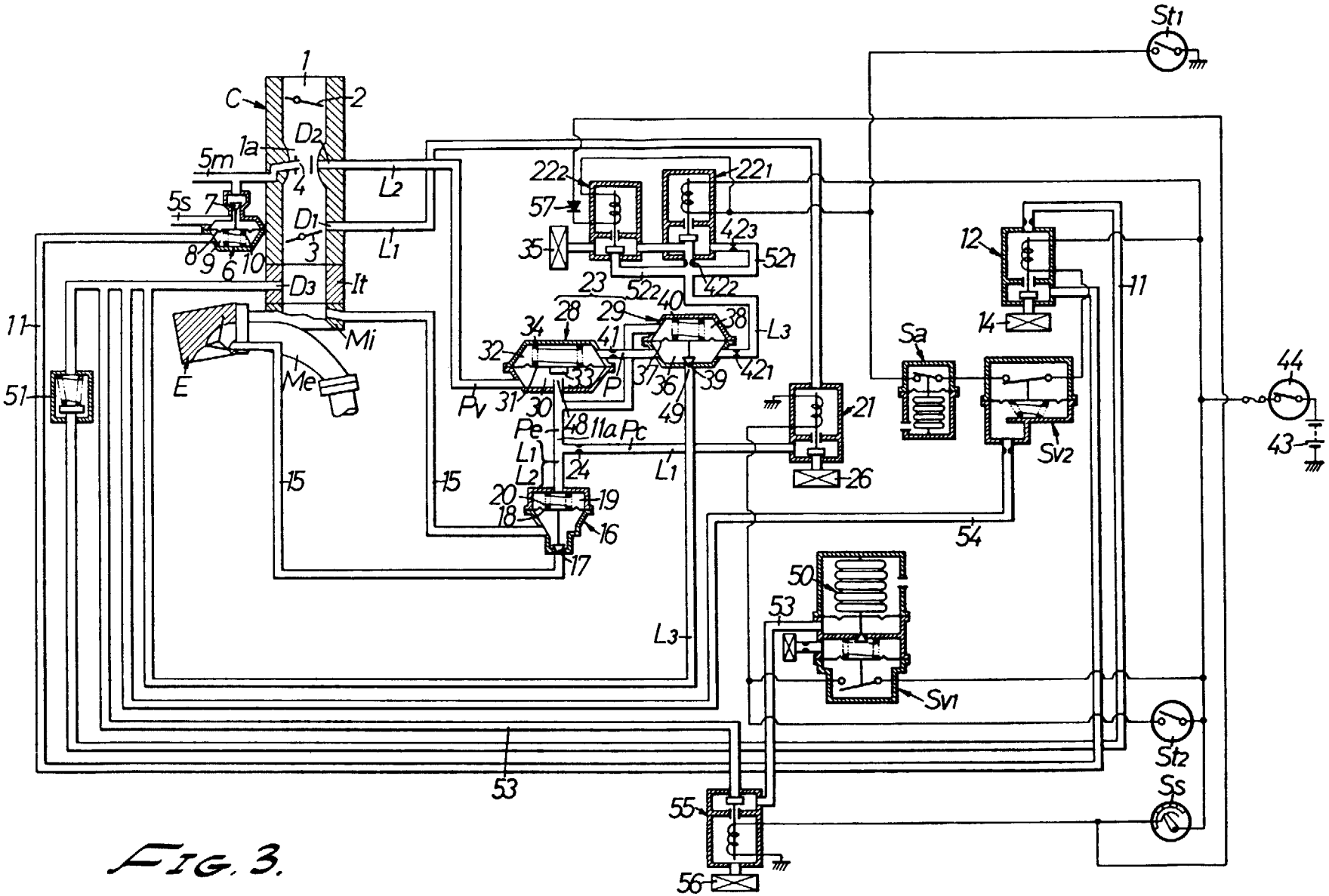

FIG. 3 illustrates a second embodiment of the present invention. FIG. 3 differs from FIG. 2 only in the provision of two solenoid valves $22_1$ and $22_2$ instead of the single solenoid valve 22, as shown in FIG. 1. First and second bypass channels $52_1$, $52_2$, are connected to the control suction air line L3 extending between the valve chamber 36 of the air valve 29 and the intake port 35, in a manner to bypass the suborifice $42_2$. The first bypass channel $52_1$ is provided with a second suborifice $42_3$ having a smaller opening than that of the suborifice $42_2$ and the solenoid valve $22_1$ which are arranged in series. The second bypass channel $52_2$ is provided with the solenoid valve $22_2$ alone. In FIG. 3, corresponding parts are designated with like reference numerals. The solenoid valve $22_1$ and $22_2$ are both of the normally closed type.

The flow resistance produced between the air intake port 35 and the air valve 29 is adjusted to a maximum value by the series-connected main orifice $42_1$ and suborifice $42_2$ when the solenoid valves $22_1$,$22_2$ are both closed (de-activated). The flow resistance is at an intermediate value through the parallel-arranged suborifices $42_2$ and $42_3$ when only the solenoid valve $22_1$ is opened (activated). The flow resistance reaches a minimum value when the main orifice $42_1$ alone is open and when the solenoid valve $22_2$ is opened. Since the flow resistance is thus adjusted in three steps, the flow rate of air passing in the control suction air line L3 can be correspondingly controlled to enable fine and accurate adjustment of the flow rate of exhaust gas being recirculated.

Figure 4:
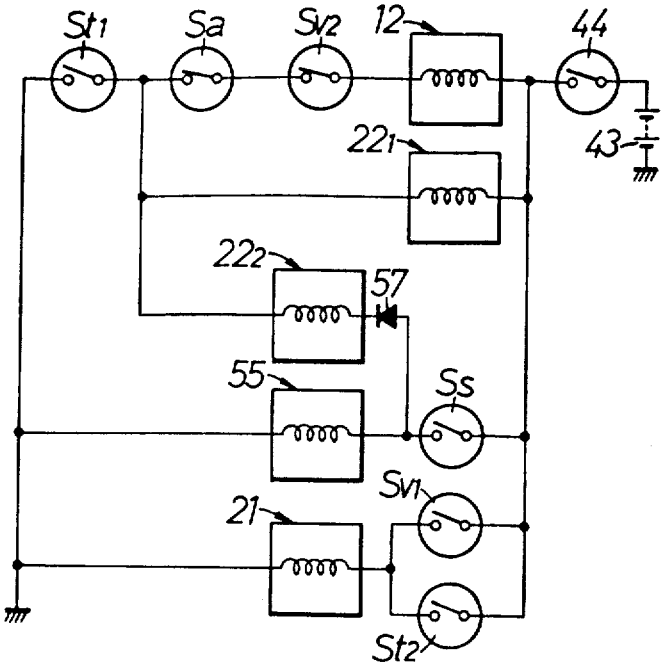
FIGS. 3 and 4 are wiring diagrams.

FIG. 4 is a wiring diagram of the control system as shown on FIG. 3 of the drawings. The solenoid valve $22_1$ and the first bypass channel $52_1$ is connected to the power source 43 by way of the first engine temperature sensing switch St1, and the solenoid valve $22_2$ in the second bypass channel $52_2$ to the power source by way of the series-connected vehicle speed sensing switch Ss and the first engine temperature sensing switch St1, respectively. Reference numeral 47 represents a diode.

The operation of the control system shown in FIG. 3 is as follows: When the engine is in a cold state, the switch St1 is open so that the solenoid valves $22_1$, $22_2$ are both closed. Accordingly, the flow resistance assumes a maximum value, keeping the flow rate of exhaust gas being recirculated to a minimum value. When the engine is in a warmed-up state with the switch St1 in the closed position, the flow resistance assumes an intermediate value if the vehicle speed is in a low speed range with the switch Ss in the open position. Thus, the flow rate of exhaust gas being recirculated is increased to a larger value. If the vehicle speed comes into a high speed range to cause the switch Ss to close, the flow resistance assumes a minimum value, further increasing the flow rate of exhaust gas being recirculated. The other operations of the embodiment shown in FIG. 3 are the same as those described in connection with the preferred embodiment of FIG. 1.

As described above, the device of the present invention employs a return gas flow rate control valve of suction pressure responsive type and located in an exhaust gas recirculation line leading to the intake passage of the engine. Also, a regulating valve is connected to a control suction air line leading from the intake passage, for controlling the actuating suction pressure acting upon the return gas flow rate control valve, in response to suction pressure produced within the control suction air line. Adjusting means are provided in the control suction air line at a location upstream of the connecting point of the regulating valve and the control suction air line, for adjusting the flow resistance in the control suction air line. In this way, the adjusting means is controlled by a prescribed control factor, together with control means for controlling auxiliary fuel supply means provided to open in said intake passage. By virtue of the above arrangement, the flow rate of exhaust gas being recirculated can be simultaneously controlled so as to increase when the quantity of auxiliary fuel being supplied to the engine is increased in response to a change in said control factor, thus enabling the device to achieve enhancement of the engine power characteristics, and reduction of air contamination at the same time. The above-mentioned control factor constitutes engine temperature in both embodiments described above, but this can be supplemented by items such as engine speed, engine load (suction pressure), and atmospheric pressure.

Having fully described our invention, it is to be understood that we are not to be limited to the details herein set forth but that our invention is of the full scope of the appended claims.

We claim:

1. In an exhaust recirculation control system for an internal combustion engine for a vehicle, the engine having an intake passage with a pressure responsive auxiliary fuel supply device, and having an exhaust gas recirculation passage, the improvement comprising, in combination: a flow regulating valve in the exhaust gas recirculation passage, said flow regulating valve being actuated by suction pressure in the engine intake passage, a regulating valve means responsive to intake passage suction pressure for controlling actuating suction pressure to said flow regulating valve, a control suction air line communicating with the intake passage and said regulating valve means, means for changing the flow resistance through the control suction air line, said means being responsive to a predetermined control factor relating to an operating condition of the engine or the vehicle, whereby said flow regulating valve and said auxiliary fuel supply device are controlled in a manner such that the flow rate of exhaust gas being recirculated and the flow rate of fuel being supplied to the engine are varied in response to said predetermined control factor.

2. The combination set forth in claim 1 in which said control factor may include temperature of engine cooling water, vehicle speed, engine load, or atmospheric pressure.

3. The combination set forth in claim 1 in which the control suction air line is provided with a plurality of orifices, and valve means for selectively directing flow through said orifices for changing the flow resistance through the control suction line.

4. An exhaust gas recirculation control system for an internal combustion engine for a vehicle, the engine having an intake passage with a pressure responsive auxiliary fuel supply device, and having an exhaust gas recirculation passage, the improvement comprising, in combination: a first suction pressure line extending from a first suction pressure detecting port opening in said intake passage at a location near a throttle valve of a carburetor provided in said intake passage, a flow regulating valve in the exhaust gas recirculation passage and having a suction chamber for operating said valve, said first suction pressure line communicating with said suction chamber, a second suction pressure detecting port opening in a venturi of said carburetor, a second suction pressure line extending from said second suction pressure detecting port, a third suction pressure detecting port opening in said intake passage at a location downstream of said throttle valve, a control suction air line extending from said third suction pressure detecting port and leading to an air intake port, a regulating valve including a valve chamber formed across said second suction pressure line, a suction pressure chamber adjacent to said valve chamber with a diaphragm intervening therebetween, a connecting line extending between said suction chamber of the flow regulating valve and the valve chamber, a valve element secured to said diaphragm for opening or closing an open end of the connecting line, an air valve including a valve chamber formed across said control suction air line and communicating with said suction pressure chamber of said regulating valve, a suction pressure chamber formed adjacent to said valve chamber with a diaphragm intervening therebetween and communicating with said suction chamber of said flow regulating valve, and a valve element secured on said diaphragm for opening or closing the downstream side of said control suction air line, means for changing the resistance to flow produced between said air valve and said air intake port, wherein said auxiliary fuel supply device and said flow regulating valve are arranged to be controlled at the same time by a predetermined control factor.

5. The combination set forth in claim 4 wherein said control factor is temperature of engine cooling water.

6. The combination set forth in claim 4 wherein the changing means comprises orifice means provided in said control suction air line at a location between said air valve and said intake port, at least one bypass channel bypassing said orifice means, and a solenoid valve for opening or closing said bypass channel.

7. The combination set forth in claim 4 wherein the changing means comprises orifice means provided in said control suction air line at a location between said air valve and said intake port, at least one bypass channel bypassing said orifice means, at least one solenoid valve for opening or closing said bypass channel, said pressure responsive auxiliary fuel supply device comprising an auxiliary fuel supply valve in the carburetor, a suction pressure conduit connecting said auxiliary fuel supply valve to the intake passage downstream from the throttle valve, and a second solenoid valve for opening or closing said suction pressure conduit.

8. The combination set forth in claim 7, wherein said bypass channel comprises first and second channels each provided with a solenoid valve, one of the solenoid valves being connected to said second solenoid valve, said solenoid valves being independently operated with respect to each other by different control factors.

9. The combination set forth in claim 8 wherein said different control factors are temperature of engine cooling water and vehicle speed.

10. In an exhaust gas recirculation control system for an internal combustion engine for a vehicle, the engine having an intake passage with a pressure responsive auxiliary fuel supply device, and having an exhaust gas recirculation passage, the improvement comprising, in combination: a flow regulating valve in the exhaust gas recirculation passage, said flow regulating valve being responsive to suction pressure in the engine intake passage, a pressure control valve means for controlling suction pressure introduced from the intake passage into the flow regulating valve, said pressure control valve means having a pressure chamber and a valve chamber, said valve chamber including a valve to regulating suction pressure introduced into the flow regulating valve, a control pressure line connecting said pressure chamber to the intake passage, an air conduit connecting said pressure chamber to atmosphere, means for changing the flow resistance through the air conduit, said means being responsive to a predetermined control factor relating to an operating condition of the engine or the vehicle, whereby said flow regulating valve and said auxiliary fuel supply device are controlled in a manner such that the flow rate of exhaust gas being recirculated and the flow rate of fuel being supplied to the engine are varied in response to said predetermined control factor.

11. The combination set forth in claim 10 in which said control factor may include temperature of engine cooling water, vehicle speed, engine load, or atmospheric pressure.

12. The combination set forth in claim 10 in which the air conduit is provided with a plurality of orifices, and valve means for selectively directing flow through said orifices for changing the flow resistance through the air conduit.

* * * * *